US010251214B2

(12) United States Patent
Gomez et al.

(10) Patent No.: US 10,251,214 B2
(45) Date of Patent: Apr. 2, 2019

(54) COOKTOP APPLIANCE

(71) Applicant: General Electric Company, Schenectady, NY (US)

(72) Inventors: Eugenio Gomez, Louisville, KY (US); James Lee Armstrong, Louisville, KY (US); Philip Ames Barber, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 674 days.

(21) Appl. No.: 14/808,120

(22) Filed: Jul. 24, 2015

(65) Prior Publication Data

US 2017/0027020 A1 Jan. 26, 2017

(51) Int. Cl.
*H05B 1/02* (2006.01)
*H05B 3/68* (2006.01)

(52) U.S. Cl.
CPC ..... *H05B 1/0213* (2013.01); *H05B 1/0258* (2013.01); *H05B 3/68* (2013.01)

(58) Field of Classification Search
CPC .. H05B 1/0213; H05B 1/0258; H05B 1/0261; H05B 1/0263; H05B 1/0266; H05B 3/68
USPC ..... 219/412–414, 483–486, 494, 497, 506, 219/509, 510
See application file for complete search history.

(56) References Cited

U.S. PATENT DOCUMENTS

RE26,944 E * 8/1970 Getman ..... F24C 15/022 126/197
4,237,368 A 12/1980 Welch
4,788,398 A * 11/1988 Hornung ..... F24C 15/106 219/448.12
5,111,027 A * 5/1992 Fowler ..... F24C 7/087 219/492
6,753,511 B2 * 6/2004 Mathews, Jr. ..... H05B 3/746 219/492

* cited by examiner

*Primary Examiner* — Mark H Paschall
(74) *Attorney, Agent, or Firm* — Dority & Manning, P.A.

(57) ABSTRACT

A cooktop appliance includes a bimetallic switch is positioned adjacent an electrical heating element. A first electrical conduit is coupled to a first terminal of the electrical heating element and is configured to operate at a first voltage, L1, with respect to ground. A second electrical conduit is configured to operate at a second voltage, L2, with respect to ground. A relay is configured such that the relay connects the second electrical conduit to a second terminal of the electrical heating element when the bimetallic switch is in the first configuration and is also configured such that the relay connects a neutral electrical conduit to the second terminal of the electrical heating element when the bimetallic switch is in the second configuration.

20 Claims, 3 Drawing Sheets

COOKTOP APPLIANCE

FIELD OF THE INVENTION

The present subject matter relates generally to cooktop appliances, such as electric cooktop appliances.

BACKGROUND OF THE INVENTION

Cooktop appliances generally include heating elements for heating cookware, such as pots, pans and griddles. A user can select a desired heating level, and operation of the heating elements is modified to match the desired heating level. For example, certain cooktop appliances include electric heating elements. During operation, the cooktop appliance operates the electric heating elements at a predetermined duty cycle or power output corresponding to a selected heating level.

Operating the electric heating elements at the predetermined duty cycle or power output corresponding to the selected heating level poses certain challenges. For example, all water within a pot may evaporate during heating of the pot, and a temperature of the pot may increase dramatically after the water evaporates. Such heating of the pot can be undesirable.

Accordingly, a cooktop appliance with features for avoiding undesired heating of a pan on the cooktop appliance would be useful. In particular, a cooktop appliance with features for reducing a power output of heating elements of the cooktop appliance when a temperature of a pan on the cooktop appliance exceeds a temperature limit would be useful

BRIEF DESCRIPTION OF THE INVENTION

The present subject matter provides a cooktop appliance is provided. The cooktop appliance includes a bimetallic switch is positioned adjacent an electrical heating element. A first electrical conduit is coupled to a first terminal of the electrical heating element and is configured to operate at a first voltage, L1, with respect to ground. A second electrical conduit is configured to operate at a second voltage, L2, with respect to ground. A relay is configured such that the relay connects the second electrical conduit to a second terminal of the electrical heating element when the bimetallic switch is in the first configuration and is also configured such that the relay connects a neutral electrical conduit to the second terminal of the electrical heating element when the bimetallic switch is in the second configuration. Additional aspects and advantages of the invention will be set forth in part in the following description, or may be apparent from the description, or may be learned through practice of the invention.

In a first exemplary embodiment, a cooktop appliance is provided. The cooktop appliance includes a panel. An electrical heating element is positioned at the panel. The electrical heating element has a first terminal and a second terminal. A bimetallic switch is positioned adjacent the electrical heating element. The bimetallic switch is configured for actuating from a first configuration to a second configuration when a temperature of the bimetallic switch exceeds a threshold temperature. A first electrical conduit is coupled to the first terminal of the electrical heating element. The first electrical conduit is configured operating at a first voltage, L1, with respect to ground. A second electrical conduit is configured for operating at a second voltage, L2, with respect to ground. The cooktop appliance also includes a neutral electrical conduit. A relay is coupled to the bimetallic switch. The relay is configured such that the relay connects the second electrical conduit to the second terminal of the electrical heating element when the bimetallic switch is in the first configuration. The relay is also configured such that the relay connects the neutral electrical conduit to the second terminal of the electrical heating element when the bimetallic switch is in the second configuration.

In a second exemplary embodiment, a cooktop appliance is provided. The cooktop appliance includes a panel. An electrical heating element positioned at the panel, the electrical heating element having a first terminal and a second terminal. A bimetallic switch is positioned adjacent the electrical heating element. The bimetallic switch is configured for actuating from a first configuration to a second configuration when a temperature of the bimetallic switch exceeds a threshold temperature. A first electrical conduit is coupled to the first terminal of the electrical heating element. The first electrical conduit has a first voltage, L1, with respect to ground. A second electrical conduit has a second voltage, L2, with respect to ground. The cooktop appliance also includes a neutral electrical conduit. A relay is coupled to the bimetallic switch. The relay is configured such that the relay connects the second electrical conduit to the second terminal of the electrical heating element and a total voltage across the first and second terminals of the electrical heating element corresponds to a difference between the first voltage L1 and the second voltage L2 when the bimetallic switch is in the first configuration. The relay is also configured such that the relay connects the neutral electrical conduit to the second terminal of the electrical heating element and the total voltage across the first and second terminals of the electrical heating element corresponds to a difference between the first voltage L1 and neutral when the bimetallic switch is in the second configuration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
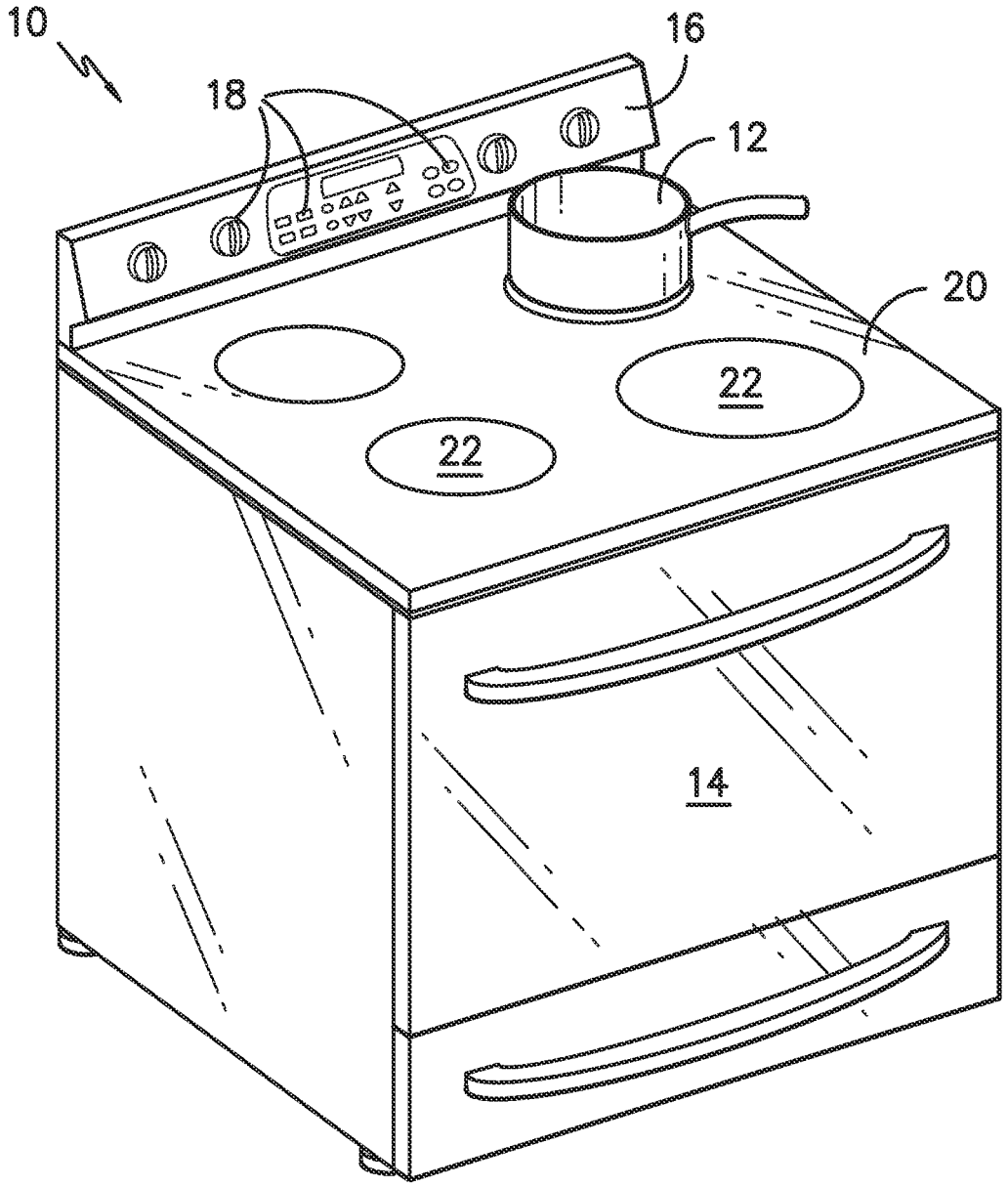
FIG. 1 provides a side, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a range appliance 10. Range appliance 10 is provided by way of example only and is not intended to limit the present subject matter to the arrangement shown in FIG. 1. Thus, the present subject matter may be used with other cooktop appliance configurations, e.g., double oven range appliances, standalone cooktop appliances, cooktop range appliances without an oven, etc.

A panel or cooking surface 20 of range appliance 10 includes heated portions comprising heating assemblies 22 that may be heated by heating elements 100 (FIG. 2) positioned below cooking surface 20. In certain exemplary embodiments, range appliance 10 may be a radiant cooktop appliance, and cooking surface 20 may be constructed of a glass, ceramic, or a combination glass-ceramic material, or any other suitable material. Heating elements 100 may be, e.g., electrical resistive heating elements and/or any other suitable heating element. Each heating assembly 22 of range appliance 10 may be heated by the same type of heating element 100, or range appliance 10 may include a combination of different types of heating elements 100. Further, heating assemblies 22 may have any suitable shape and size, and a combination of heating assemblies of different shapes and sizes may be used.

As shown in FIG. 1, a cooking utensil 12, such as a pot, pan, or the like, may be placed on a heating assembly 22 to cook or heat food items placed in cooking utensil 12. Range appliance 10 also includes a door 14 that permits access to a cooking chamber (not shown) of range appliance 10, e.g., for cooking or baking of food items therein. A control panel 16 having controls 18 permits a user to make selections for cooking of food items; although shown on a backsplash or back panel of range appliance 10, control panel 16 may be positioned in any suitable location. Controls 18 may include buttons, knobs, and the like, as well as combinations thereof. As an example, a user may manipulate one or more controls 18 to select a temperature and/or a heat or power output for each heating assembly 22. The selected temperature or heat output of heating assembly 22 affects the heat transferred to cooking utensil 12 placed on heating assembly 22, as further described below.

Operation of heating element 100 may be regulated such that the temperature or heat output of heating assembly 22 corresponds to a temperate or heat output selected by a user of cooktop appliance 10. For example, heating element 100 may be cycled between an activated state and a deactivated state, i.e., between on and off, such that the average temperature or heat output over each cycle approximates the selected temperature or heat output. That is, a duty cycle of heating element 100 may be controlled such that, based on the user's selection, heating element 100 is activated or turned on for a fraction or portion of the duty cycle and deactivates or turns off heating element 100 for the remainder of the duty cycle. As a particular example, a bi-metal infinite switch may control the duty cycle of heating element 100, e.g., by opening or closing to regulate the amount of time heating element 100 is on during the duty cycle. More specifically, a user of range appliance 10 may, e.g., manipulate a control 18 associated with a heating assembly 22 to select a desired heat output or temperature for heating element 100 of the associated heating assembly 22. The selection by the user indicates what fraction or portion of the duty cycle heating element 100 should be activated or on, e.g., if the user selects the midpoint heat output or temperature, the duty cycle of heating element 100 may be controlled such that heating element 100 is on for half of the duty cycle and off for half of the duty cycle.

Figure 2:
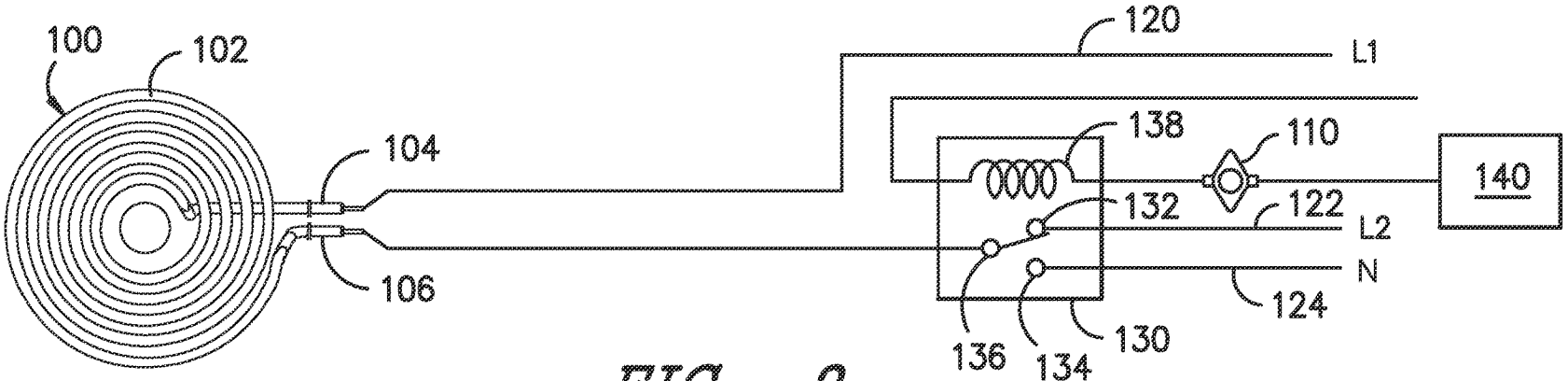
FIGS. 2 and 3 provide schematic view of certain components of the exemplary range appliance of FIG. 1.
Figure 3:
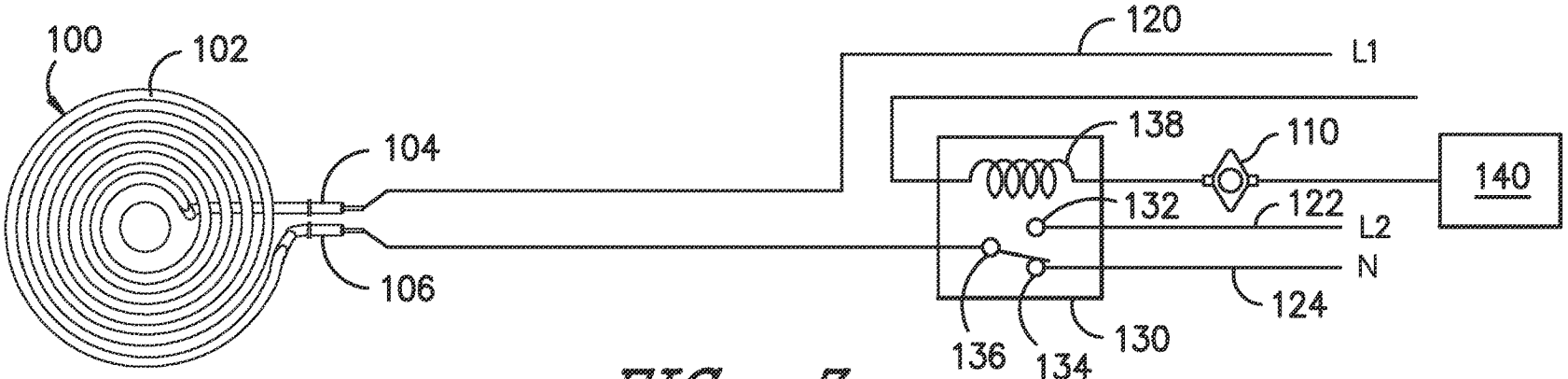

FIGS. 2 and 3 provide schematic view of certain components of range appliance 10. As may be seen in FIGS. 2 and 3, range appliance 10 includes an electrical heating element 100. As discussed above, electrical heating element 100 may be positioned at cooking surface 20 of range appliance 10. Electrical heating element 100 may be formed into a coil 102 and include a first terminal 104 and a second terminal 106. As will be understood by those skilled in the art, when a voltage differential is applied across first and second terminals 104, 106 of electrical heating element 100, a temperature of electrical heating element 100 increases. Electrical heating element 100 may be a calrod coil in certain exemplary embodiments.

A bimetallic switch 110 is positioned adjacent electrical heating element 100. In particular, bimetallic switch 110 may be positioned such that a temperature of bimetallic switch 110 corresponds to a temperature of cooking surface 20 or cooking utensil 12 (FIG. 1) above electrical heating element 100. Thus, bimetallic switch 110 may be configured for measuring the temperature of cooking surface 20 or cooking utensil 12 above electrical heating element 100.

Bimetallic switch 110 is configured for actuating from a first configuration (FIG. 2) to a second configuration (FIG. 3). In particular, bimetallic switch 110 actuates or adjusts from the first configuration to the second configuration when the temperature of bimetallic switch 110 exceeds a threshold temperature. Thus, the materials of bimetallic switch 110 may be selected to such that bimetallic switch 110 triggers or trips at the threshold temperature. The threshold temperature may be any suitable temperature. For example, the threshold temperature may be about three hundred and twenty-five degrees Celsius. As another example, the threshold temperature may be between about ninety degrees Celsius and about four hundred degrees Celsius. As used herein, the term "about" corresponds to within twenty-five degrees of a stated temperature when used in the context of temperature. The threshold temperature may be may be selected such that the threshold temperature accounts for a position of bimetallic switch 110 relative to cooking surface 20 and/or cooking utensil 12 above electrical heating element 100.

A first electrical conduit 120 is coupled to first terminal 104 of electrical heating element 100. First electrical conduit 120 is configured for operating at a first voltage, L1, with respect to ground. Thus, first electrical conduit 120 may be coupled or connected to a first voltage source operating at the first voltage L1 with respect to ground. Range appliance 10 also includes a second electrical conduit 122 and a neutral electrical conduit 124. Second electrical conduit 122 is configured for operating at a second voltage, L2, with respect to ground. Thus, second electrical conduit 122 may be coupled or connected to a second voltage source operating at the second voltage L2 with respect to ground. Neutral electrical conduit 124 is configured for operating at neutral. Thus, neutral electrical conduit 124 may be grounded. The first, second and neutral electrical conduits 120, 122, 124 may be any suitable electrical conduits, such as wires, cables, etc.

The first voltage L1 and the second voltage L2 have opposite polarities. In addition, a magnitude of the first voltage L1 with respect to ground may be about equal to a magnitude the second voltage L2 with respect to ground. As used herein, the term "about" corresponds to within ten volts of a stated voltage when used in the context of voltage. As an example, the magnitude of the first and second voltages L1, L2 may be about one hundred and twenty volts with respect to ground. Thus, e.g., first electrical conduit 120 may be coupled to one phase of a two-hundred and forty volt household electrical supply, and second electrical conduit 122 may be coupled to the second phase of the two-hundred and forty volt household electrical supply. Neutral electrical conduit 124 may be grounded. By selectively coupling or connecting the second terminal 106 of electrical heating element 100 to either second electrical conduit 122 or neutral electrical conduit 124, a power output of electrical heating element 100 may be regulated with bimetallic switch 110, as discussed in greater detail below.

Range appliance 10 includes a relay 130. Relay 130 is coupled to bimetallic switch 110. As shown in FIG. 2, relay 130 is configured such that relay 130 couples or connects second electrical conduit 122 to second terminal 106 of electrical heating element 100 when bimetallic switch 110 is in the first configuration. Conversely, relay 130 is configured such that relay 130 connects neutral electrical conduit 124 to second terminal 106 of electrical heating element 100 when bimetallic switch 110 is in the second configuration as shown in FIG. 3. Thus, second terminal 106 of electrical heating element 100 may be coupled or connected to either second electrical conduit 122 or neutral electrical conduit 124 depending upon the temperature of bimetallic switch 110.

In certain exemplary embodiments, relay 130 may be a single pole, double throw relay, as shown in FIGS. 2 and 3. Thus, relay 130 may include a normally closed (NC) terminal 132, a normally open (NO) terminal 134 and a common terminal 136. Second electrical conduit 122 may be coupled or connected to NC terminal 132 of relay 130, and neutral electrical conduit 124 may be coupled or connected to NO terminal 134 of relay 130. Second terminal 106 of electrical heating element 100 may be coupled or connected to common terminal 136 of relay 130.

As shown in FIGS. 2 and 3, range appliance 10 also includes a power supply 140, such as a direct current (DC) power supply. Power supply 140 may have any suitable voltage. For example, power supply 140 may be low voltage, e.g., twelve volts with respect to ground. A coil 138 of relay 130 is connected in series with power supply 140 and bimetallic switch 110. Bimetallic switch 110 interrupts the series electrical connection between coil 138 of relay 130 and power supply 140 when bimetallic switch 110 is in the second configuration (FIG. 3). Thus, relay 130 switches from the configuration shown in FIG. 2 to the configuration shown in FIG. 3 when the temperature of bimetallic switch 110 exceeds the threshold temperature. In such a manner, relay 130 may assist with reducing a power output of electrical heating element 100 depending upon the temperature of bimetallic switch 110, as discussed in greater detail below.

Figure 4:
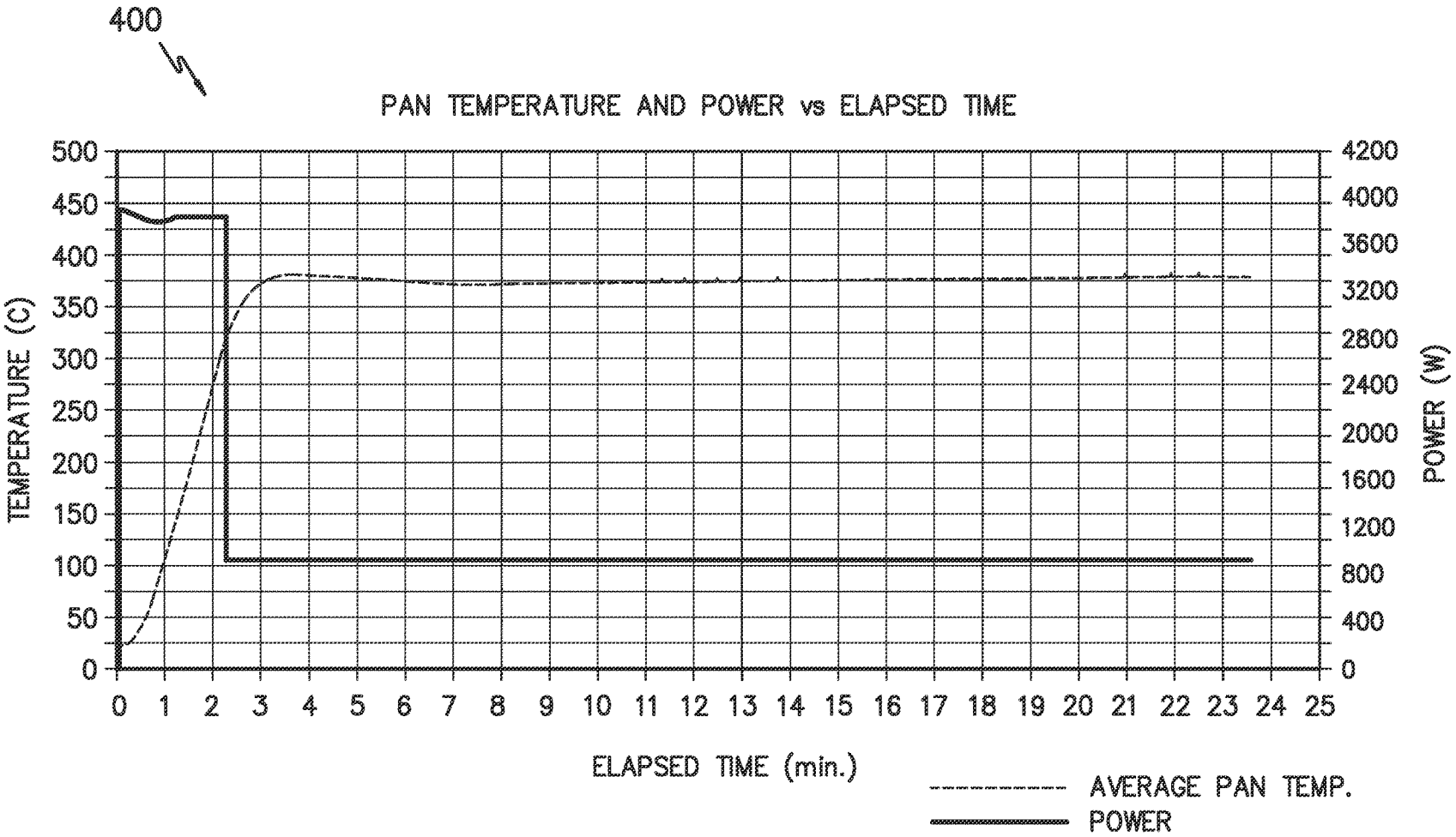
FIG. 4 provides a plot of temperature and power versus time according to an exemplary embodiment of the present subject matter.

FIG. 4 provides a plot 400 of temperature and power versus time according to an exemplary embodiment of the present subject matter. As may be seen in FIG. 4, during an initial portion (e.g., about the first two minutes) of plot 400, the power output of electrical heating element 100 about thirty-six hundred watts. The initial portion of plot 400 corresponds to a period when bimetallic switch 110 is in the first configuration. As shown in FIG. 4, when the temperature of bimetallic switch 110 remains below three hundred and seventy-five degrees Celsius, bimetallic switch 110 remains in the first configuration. In the first configuration, a total voltage across first and second terminals 104, 106 of electrical heating element 100 corresponds to a difference between the first voltage L1 and the second voltage L2. As an example, when bimetallic switch 110 is in the first configuration, the total voltage across first and second terminals 104, 106 of electrical heating element 100 may be about two-hundred and forty volts with respect to ground.

After the initial portion (e.g., after the first two minutes) of plot 400, the power output of electrical heating element 100 decreases to about nine hundred watts. The portion of plot 400 after the initial portion corresponds to a period when bimetallic switch 110 is in the second configuration. As shown in FIG. 4, when the temperature of bimetallic switch 110 exceeds three hundred and seventy-five degrees Celsius, bimetallic switch 110 adjusts from the first configuration to the second configuration. In the second configuration, a total voltage across first and second terminals 104, 106 of electrical heating element 100 corresponds to a difference between the first voltage L1 and neutral. As an example, when bimetallic switch 110 is in the second configuration, the total voltage across first and second terminals 104, 106 of electrical heating element 100 may be about one-hundred and twenty volts with respect to ground.

Accordingly, the power output of electrical heating element 100 may decrease by no less than fifty percent when bimetallic switch 110 actuates from the first configuration to the second configuration, in certain exemplary embodiments. In particular, the power output of electrical heating element 100 may decrease by no less than thirty percent (e.g., twenty-five percent) when bimetallic switch 110 actuates from the first configuration to the second configuration, in certain exemplary embodiments.

In such a manner, bimetallic switch 110 and relay 130 may assist with reducing the power output of electrical heating element 100, e.g., when a temperature of cooking surface 20 or a pan on cooking surface 20 detected by bimetallic switch 110 exceeds the threshold temperature limit, and overheating of cooking utensil 12 may be avoided or limited. In addition, such features may be provided without a digital temperature sensor for measuring the temperature of cooking surface 20 or cooking utensil 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a panel;

an electrical heating element positioned at the panel, the electrical heating element having a first terminal and a second terminal;

a bimetallic switch positioned adjacent the electrical heating element, the bimetallic switch configured for actuating from a first configuration to a second configuration when a temperature of the bimetallic switch exceeds a threshold temperature; and a first electrical conduit coupled to the first terminal of the electrical heating element, the first electrical conduit configured operating at a first voltage, L1, with respect to ground;

a second electrical conduit configured for operating at a second voltage, L2, with respect to ground; the first voltage L1 is different from the second voltage L2;

a neutral electrical conduit;

a relay coupled to the bimetallic switch, the relay configured such that the relay connects the second electrical conduit to the second terminal of the electrical heating element when the bimetallic switch is in the first configuration, the relay also configured such that the relay connects the neutral electrical conduit to the second terminal of the electrical heating element when the bimetallic switch is in the second configuration.

2. The cooktop appliance of claim 1, wherein the relay comprises a single pole, double throw relay.

3. The cooktop appliance of claim 2, wherein the second electrical conduit is connected to a normally closed (NC) terminal of the single pole, double throw relay, the neutral electrical conduit connected to a normally open (NO) terminal of the single pole, double throw relay, the second terminal of the electrical heating element connected to a common terminal of the single pole, double throw relay.

4. The cooktop appliance of claim 3, further comprising a power supply, a coil of the relay connected in series with the power supply and the bimetallic switch.

5. The cooktop appliance of claim 4, wherein the bimetallic switch interrupts the series electrical connection between the coil of the relay and the power supply when the bimetallic switch is in the second configuration.

6. The cooktop appliance of claim 1, wherein a power output of the electrical heating element decreases by no less than fifty percent when the bimetallic switch actuates from the first configuration to the second configuration.

7. The cooktop appliance of claim 1, wherein the threshold temperature is about one hundred degrees Celsius.

8. The cooktop appliance of claim 1, wherein the first voltage L1 and the second voltage L2 have opposite polarities and a magnitude of the first voltage L1 with respect to ground is about equal to a magnitude the second voltage L2 with respect to ground.

9. The cooktop appliance of claim 8, wherein the neutral electrical conduit is grounded.

10. The cooktop appliance of claim 9, wherein the magnitude of the first voltage L1 is about one hundred and twenty volts with respect to ground.

11. A cooktop appliance, comprising:

a panel;

an electrical heating element positioned at e panel, the electrical heating element having a first terminal and a second terminal;

a bimetallic switch positioned adjacent the electrical heating element, the bimetallic switch configured for actuating from a first configuration to a second configuration when a temperature of the bimetallic switch exceeds a threshold temperature; and a first electrical conduit coupled to the first terminal of the electrical heating element, the first electrical conduit having a first voltage, L1, with respect to ground;

a second electrical conduit having a second voltage, L2, with respect to ground;

a neutral electrical conduit; the first voltage L1 is different from the second voltage L2;

a relay coupled to the bimetallic switch, the relay configured such that the relay connects the second electrical conduit to the second terminal of the electrical heating element and a total voltage across the first and second terminals of the electrical heating element corresponds to a difference between the first voltage L1 and the second voltage L2 when the bimetallic switch is in the first configuration, the relay also configured such that the relay connects the neutral electrical conduit to the second terminal of the electrical heating element and the total voltage across the first and second terminals of the electrical heating element corresponds to a difference between the first voltage L1 and neutral when the bimetallic switch is in the second configuration.

12. The cooktop appliance of claim 11, wherein the relay comprises a single pole, double throw relay.

13. The cooktop appliance of claim 12, wherein the second electrical conduit is connected to a normally closed (NC) terminal of the single pole, double throw relay, the neutral electrical conduit connected to a normally open (NO) terminal of the single pole, double throw relay, the second terminal of the electrical heating element connected to a common terminal of the single pole, double throw relay.

14. The cooktop appliance of claim 13, further comprising a power supply, a coil of the relay connected in series with the power supply and the bimetallic switch.

15. The cooktop appliance of claim 14, wherein the bimetallic switch interrupts the series electrical connection between the coil of the relay and the power supply when the bimetallic switch is in the second configuration.

16. The cooktop appliance of claim 11, wherein a power output of the electrical heating element decreases by no less than fifty percent when the bimetallic switch actuates from the first configuration to the second configuration.

17. The cooktop appliance of claim 11, wherein the threshold temperature is about one hundred degrees Celsius.

18. The cooktop appliance of claim 11, wherein the first voltage L1 and the second voltage L2 have opposite polarities and a magnitude of the first voltage L1 with respect to ground is about equal to a magnitude the second voltage L2 with respect to ground.

19. The cooktop appliance of claim 18, wherein neutral electrical conduit is grounded.

20. The cooktop appliance of claim 19, wherein the magnitude of the first voltage L1 is about one hundred and twenty volts with respect to ground.

* * * * *